US005586368A

United States Patent [19]

Nelson

[11] Patent Number: 5,586,368

[45] Date of Patent: Dec. 24, 1996

[54] LOCKING ATTACHMENT

[76] Inventor: Richard L. Nelson, R.R. #3, Box 50 H, Pelican Rapids, Minn. 56572

[21] Appl. No.: 436,527

[22] Filed: May 8, 1995

[51] Int. Cl.[6] ..... A44B 19/00

[52] U.S. Cl. ..... 24/390; 24/429; 24/370; 24/387

[58] Field of Search ..... 24/390, 433, 403, 24/387, 419, 429, 430, 370; 294/3.6

[56] References Cited

U.S. PATENT DOCUMENTS

| | | | |
|---|---|---|---|
| 1,174,103 | 3/1916 | Torrey | 24/370 |
| 1,294,617 | 2/1919 | Cartisser | 24/370 |
| 1,403,988 | 1/1922 | Sundback | 24/403 |
| 3,641,634 | 2/1972 | Asai | 24/429 |
| 4,928,363 | 5/1990 | Easton | 24/370 |
| 5,008,985 | 4/1991 | Thompson | 24/429 |
| 5,400,480 | 3/1995 | Futch, III | 24/387 |

FOREIGN PATENT DOCUMENTS

| | | | |
|---|---|---|---|
| 1243522 | 9/1960 | France | 24/387 |
| 0317856 | 2/1935 | Italy | 294/3.6 |

*Primary Examiner*—Victor N. Sakran
*Attorney, Agent, or Firm*—Robert E. Kleve

[57] ABSTRACT

The invention comprises an additional zipper lock attachment. The zipper lock attachment is form of a spring steel rod with its ends overlapping one another in parallel flush engaged position. An intermediate portion of the steel rod has lateral bend. The ring is of a size whereby a wearer of jeans having a front opening with an overlapping row of lugs on one side of the opening and on the other side of the opening which may be locked into one another by a zipper closure operated by a handle, and wherein the handle has an opening, and wherein the jeans have a front button for buttoning the other side of the opening onto the one side, will take the attachment and insert one of the overlapping ends through the eyelet in the handle by momentarily separating the ends, once the zipper closure has been zipped to the top of the zipper to close the opening, and thereupon will slip the overlapping ends of the ring like attachment over and onto the button to attach the attachment to the zipper closure and the jeans to lock the zipper closure in a closed position. Thereafter, the other side panel of the jeans may be buttoned over the ring attachment, while the ring is attached onto the button.

1 Claim, 1 Drawing Sheet

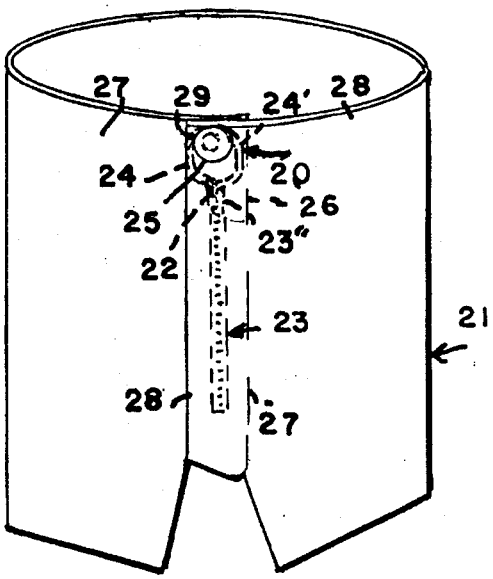
FIG.1
FIG.2
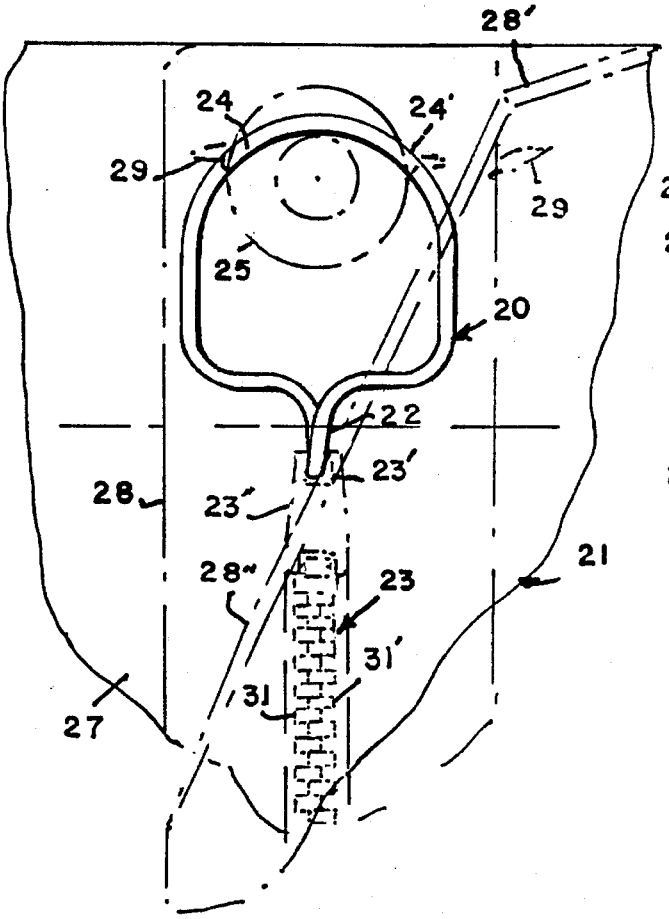
FIG.3
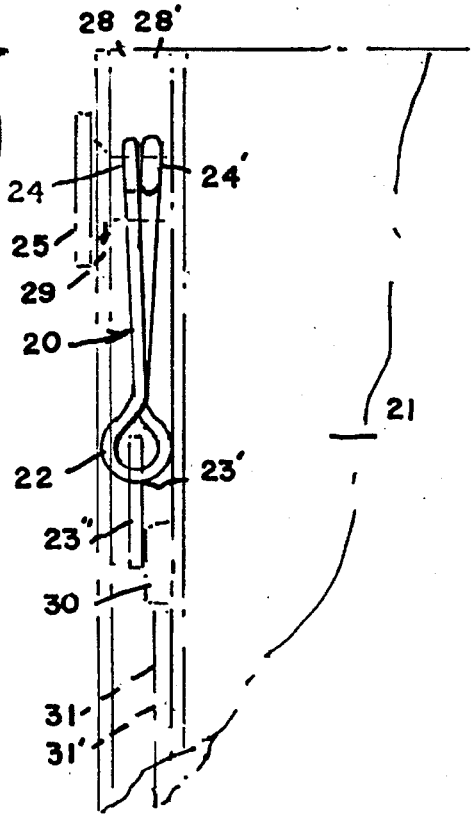

LOCKING ATTACHMENT

This invention relates to clothing attachments, more particularly, the invention relates to attachments to zippers.

It is an object of the invention tp provide a novel attachment between a zipper and the wearing apparel, to which zipper is installed to open and close an opening on the apparel to provide an additional lack to the zipper to preven it accidentally unzipping.

It is a further object of the invention to provide a novel ring like attachement between the zipper operating handle and a portion of apparel to which apparel the zipper is attached to open and close an opening on the apparel, as an additional lock on the zipper to prevent an accidental unzipping of the zipper.

It is a further object of the invention to provide an novel locking device to prevent the accidental unzipping of a zipper.

Further objects and advantages of the invention will become apparent as the description proceeds and when taken in conjunction with the accompanying drawing wherein:

BRIEF DESCRIPTION OF THE DRAWING

FIG. 1 is a front elevational view of the ring like attachment invention shown attached to the operating handle of the zipper, when the zipper is zipped closed, at the bottom of the ring; and shown slipped over the front button a pair of jeans, wherein the zipper is installed to close the front opening in the jeans, with the attachment of the ring like invention over the button preventing the zipper from accidentally unzipping and opening the opening.

FIG. 2 is an enlarged front elevational view of the ring like attachment shown attached between the operating handle of the zipper on the pail of jeans and the front button the the jeans, similar to the view of FIG. 1.

FIG. 3 is a side elevational view of the invention shown installed.

BRIEF DESCRIPTION OF PREFERRED EMBODIMENT

Briefly stated, the invention comprises a ring like atachment between the operating handle of a zipper, wherein the zipper is attached over the front opening in a pair of jeans, and the front button of a pair of jeans to prevent the zipper closure to which the operating handle is attached from unzipping downward accidentally or unintentionally. The attachment has a pair of spring like, overlapping upper ends to form the ring, which ends can be separated to allow attachment of the ring through the opening in the operating handle of the zipper. The bottom of the ring has a lateral bend to enable the rest ring to remain parallel to the front of the zipper, while the ring extends laterally through the opening in the zipper.

Referring more particuarly to the drawing, in FIG. 1, the ring like zipper lock attachment 20 is shown attached to the front of a pair of jeans 21, by the bottom lateral bent portion 22 of the ring 20 shown inserted in the opening 23' of the operating handle 23" of a zipper 23. The ring 20 is formed of spring steel rod, with a pair of overlapping ends 24 and 24' formed in a closed overlapping engaged position under the spring urging of the ring. The overlapping ends 24 and 24' have a large enough curved ends to enable the ring 20 to be slipped or attached over the front button 25 conventional to the front of the jeans. The front button 25 is normally attached to the one side panel 27 forming one side of the opening, while the other side front panel 28 of the pair of jeans forming the front opening 28' in the jeans has an eyelet 29 which can be buttoned over the button 25 of the jeans, after the conventional zipper closure 30 of the zipper 23 has been zipped up to the top, latching the conventional lugs 31 and 31' on each side of the zipper in their interlocking closed position.

The zipper operating handle customarily has a lock tab which engages in the closure to lock the zipper from unzipping. However, after many zippers have been operated for an extended period of time, these locks which customarily hold the zipper from unlocking become worn and can easily come out of their locked position while a person is wearing the jeans, and once this lock has become unlocked, the zipper closure, through the operator's movement in wearing the jeans, will sometimes unzip downward causing the front opening to be open by the separating of the overlapping lugs on one side of the zipper from the lugs on the other side of the zipper.

The lock attachment invention operates to provide an additional lock for the zipper which prevents such accidental or unintentional unzipping of the zipper just described.

Operation:

The zipper lock attachment 20 is operated as follows:

The wearer of the jeans will put the jeans on and will zip the zipper closure 30 upward causing the overapping lugs 31 and 31' of the zipper to interlock with one another in an overlapping position in a conventional manner. When the operator has zipped the closure to the top of the zipper, he will then take the ring like lock attachment and physically separate the ends 24 and 24'. While holding them apart, he will insert one end 24 or 24' through the eyelet 23' of the zipper closure and slide the ring through the eyelet until the lateral bent portion 22 reaches the eyelet. When the lateral bent portion of the ring reaches the eyelet, the ring can be swung into a parallel, flush position to the front of the pair of jeans, as shown in FIGS. 1–3. Whereupon, the overlapping end 24 and 24' will be slipped over the front button 25 on the one side panel 27 of the jeans while the other side panel having the button opening 29 is unbuttoned from the button 25 of the jeans.

Then, when the overlapping ends 24 and 24' have been slipped over and onto the top of the rear of the button 25, as shown in FIG. 2 in solid lines and in FIG. 3; the wearer will take the front panel 28 of the jeans and move it from its position 28" to its position indicated by numeral 28 and button it to the button 25, by inserting the button into the button opening 29 in the jeans. This covers up the ring like attachment invention 20 from view from the front. The buttoning further provides an additional lock of the ring onto the button to prevent the ring invention from accidentally or inadvertently slipping off the button.

The ring attachment invention 20 may be left permanently on the zipper closure handle 23" and may be used to assist in unzipping and zipping the closure 30 along the zipper 23 to open and close the front opening 28" between the side panels 27 and 28 of the jeans. The spring urging of ends 24 and 24' of the rod into overlapping engaging relation will prevent accidental sliding of the rod off the handle.

Thus, it will be seen that a novel additional zipper lock attachment 20 has been provided which can be easily and inexpensively made and installed. Further, once the attachment is installed and is placed in its operative position over the front button, the buttoning of the one side panel to the button on the other panel covers the attachment from view so that it is not even apparent that the attachment is installed.

The ring will be slipped off the button each time the zipper closure is zipped downward to open the opening and will be returned to its position over the button each time the zipper closure is zipped upward closing the opening, with the ring left permanently on the closure handle 23".

It will be obvious that various changes and departures may be made to the invention without departing from the spirit and scope thereof; and accordingly, it is not intended that the invention be limited to that specifically described in the specification, or as illustrated in the drawing, but only as set forth in the appended claims wherein:

What is claimed is:

1. A zipper lock attachment for a pair of jeans wherein the jean have a pair of front panels with a zipper mounted across the inner edges of the front panels for opening and closing the front panels, and wherein a button is mounted to one of the panels above the zipper with the other of the front panels having a button opening for buttoning said other of said panels to said one panel, comprising a one piece ring like resilient rod formed into a ring like shape and having its remote ends overlapping one another in parallel relation for a portion of the length of the rod with the ends spring urged together along an upper portion of its ring like shape, said ring like rod having a downwardly bent loop portion along the bottom of its ring like shape bent downward into a relatively small loop with relatively small inner radius in relation to the ring like rod's inner radius and with the small loop formed about an axis perpendicular to the axis of the ring like rod, wherein said ring like rod have its upper overlapping ends manually urged apart sufficiently to insert their ends into an eyelet of a zipper handle of the zipper, and when said zipper has been zipped upward to close the zipper opening, the upper overlapping ends of the ring like rod be slipped over the button of the jeans to secure the zipper in its upper closed position on the panels of the jeans with the zipper handle resting in the small loop of the rod.

* * * * *